United States Patent [19]

Coleman

[11] 4,195,842

[45] Apr. 1, 1980

[54] GOLF CLUB AND PROCESS FOR MAKING SAME

[76] Inventor: Marvin W. Coleman, 10607 Moore St., Fairfax, Va. 22030

[21] Appl. No.: 867,872

[22] Filed: Jan. 9, 1978

Related U.S. Application Data

[63] Continuation-in-part of Ser. No. 711,960, Aug. 5, 1976, Pat. No. 4,067,572.

[51] Int. Cl.[2] ..... A63B 53/02

[52] U.S. Cl. ..... 273/171; 29/415; 273/80.2

[58] Field of Search ..... 273/77 R, 78, 79, 80 C, 273/80.1-80.8, 164, 167-175

[56] References Cited

U.S. PATENT DOCUMENTS

| | | | |
|---|---|---|---|
| 1,064,916 | 6/1913 | Kelly et al. | 273/173 X |
| 1,091,231 | 3/1914 | Millar | 273/169 |
| 1,567,248 | 12/1925 | Dahlman | 273/173 X |
| 2,222,534 | 11/1940 | Harris | 273/79 |
| 2,346,617 | 4/1944 | Schaffer | 273/80.2 |
| 2,932,515 | 4/1960 | May | 273/80.1 |
| 3,190,651 | 6/1965 | Thomas | 273/173 X |
| 3,191,936 | 6/1965 | Guier | 273/80.2 |
| 3,212,783 | 10/1965 | Bradley et al. | 273/167 F X |
| 3,214,169 | 10/1965 | Rupnow | 273/80.1 X |
| 3,260,525 | 7/1966 | Ortel | 273/171 X |
| 3,343,839 | 9/1967 | Borah | 273/167 G X |
| 3,547,445 | 12/1970 | Hardesty | 273/173 |
| 3,567,228 | 3/1971 | Lynn | 273/169 |
| 3,759,527 | 9/1973 | Witherspoon | 273/171 |
| 3,817,534 | 6/1974 | Carlino | 273/171 X |
| 3,840,231 | 10/1974 | Moore | 273/79 |
| 3,873,094 | 3/1975 | Sebo et al. | 273/80.2 X |

FOREIGN PATENT DOCUMENTS

| | | | |
|---|---|---|---|
| 1230 | of 1907 | United Kingdom | 273/79 |
| 194823 | 3/1923 | United Kingdom | 273/171 |

*Primary Examiner*—Richard J. Apley

*Attorney, Agent, or Firm*—Shlesinger, Arkwright, Garvey & Dinsmore

[57] ABSTRACT

The present invention is a golf club having a club head of generally semi-ellipsoidal shape and including a hosel which connects the club head to a shaft. A weight member extends from the striking face of the club head rearwardly and means are provided for varying the total weight of the member. Club heads are made in pairs by machining a block of material until it is of substantially ellipsoidal shape, and then cutting the same in half at a selected predetermined, but variable, angle in order to produce club heads having striking faces of different angularity for effecting differences in loft and distance when a golf ball is struck.

15 Claims, 14 Drawing Figures

GOLF CLUB AND PROCESS FOR MAKING SAME

This application is a continuation-in-part of application Ser. No. 711,960 filed Aug. 5, 1976, now U.S. Pat. No. 4,067,572.

BACKGROUND OF INVENTION

Golf is said to be a thinking man's game, yet it is the poorest equipped of any major sport according to leading golf authorities. The "thinking" of the golfer is not with regard to improvement of the golfer's paraphernalia, but rather is directed to strategy for shooting a good game with the equipment at hand.

Despite progress which has been made in various sport equipment, golfers are still swinging golf clubs which are deliberately patterned after crude cudgels which were originally used many years ago when the game was invented.

Golf clubs are conventionally designed with the hosel, which connects the shaft to the club head, engaged with the inboard end of the head. Consequently, when the golf club is swung, the head, which extends outwardly as an elongated weight from the hosel, is highly vulnerable to off center resistance so that any foreign object, even a blade of grass, encountered close to either end of the head causes the weight to swing in the direction of the resistance, which results in off line hits. The same effect is obtained when the ball is struck off center, causing the club and club head to twist or torque as the ball is struck.

Various means have been devised to tailor the design of conventional club heads and shafts to the swing of a particular individual in order to minimize, as much as possible, hooking, slicing, off line hits, etc. which can be attributed to the golfer's swing. Also, weights are added to club heads in various places in order that the weight of the club head may be the optimum to produce the maximum force when the ball is struck. These weights are usually off center of the striking face of the golf club and, by necessity, are an additional error-producing factor when the ball is struck off center by the weighted club head.

As a result of the above factors, good golfers, and even professionals, have tremendous difficulty in consistently hitting golf balls with woods and irons accurately and at the same time getting maximum distance with their shots.

SUMMARY OF THE INVENTION

The present golf club is designed to simplify the structure of the club head, and provide a golf club having a head of aerodynamic shape which consistently drives a ball the maximum distance and in a straight line.

This golf club includes a head which is of semi-ellipsoidal shape to present less air resistance than conventional clubs when swung, and wherein the club head is centered with respect to the shaft.

The present golf club further is provided with weight means which is positioned rearwardly of the center of the ball-engaging face of the club head and centered on the club shaft so that maximum force is transmitted to the ball by the weight means. The weight means includes a plurality of weight members made of different materials, thereby providing members of different weight value. These members may be selectively added to, removed from, or arranged in different ways to place more weight proximate the center or the aft end of the club head.

Due to the centering of the club head on the shaft and the alignment of the weight directly behind the striking face of the club head, greater force can be applied to the golf ball when the golf club is swung and, accordingly, the golf ball can be hit a greater distance than with a conventional comparable club. Even in the event that the golf ball is struck off center, the centralization of the weight and the golf club with respect to the shaft minimizes torqueing, with the result that the golf ball will fly straighter than when hit off center with a conventional golf club.

DESCRIPTION OF FORM OF INVENTION ILLUSTRATED IN FIGS. 1 TO 7

In FIGS. 1 to 7 there is illustrated a golf club constructed in accordance with the present invention which includes a shaft 20 made of graphite, steel or other suitable material, and of any desired length, the upper end of which is provided with a hand grip 22 and the lower end of which is connected to a club head assembly generally designated 24.

Figure 1:
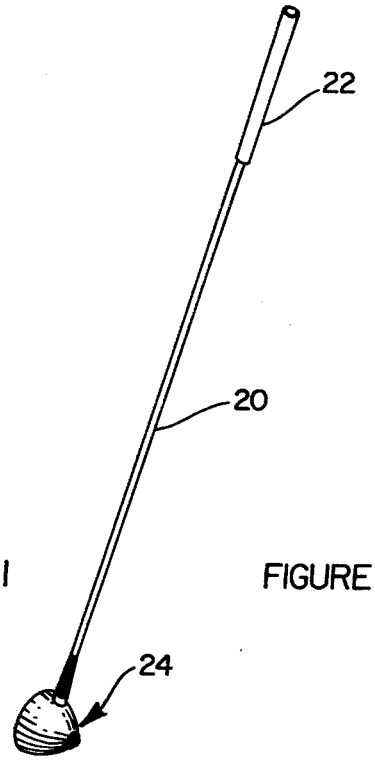
FIG. 1 is a perspective view of a golf club made in accordance with the present invention.
Figure 2:
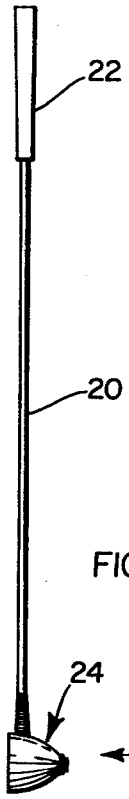
FIG. 2 is a side elevational view thereof.
Figure 3:
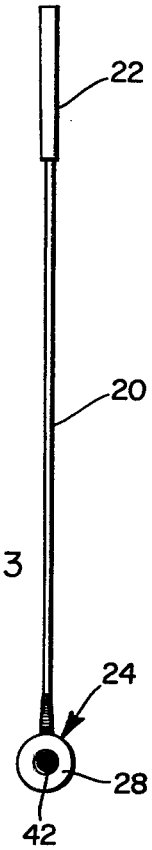
FIG. 3 is a front elevational view thereof.
Figure 5:
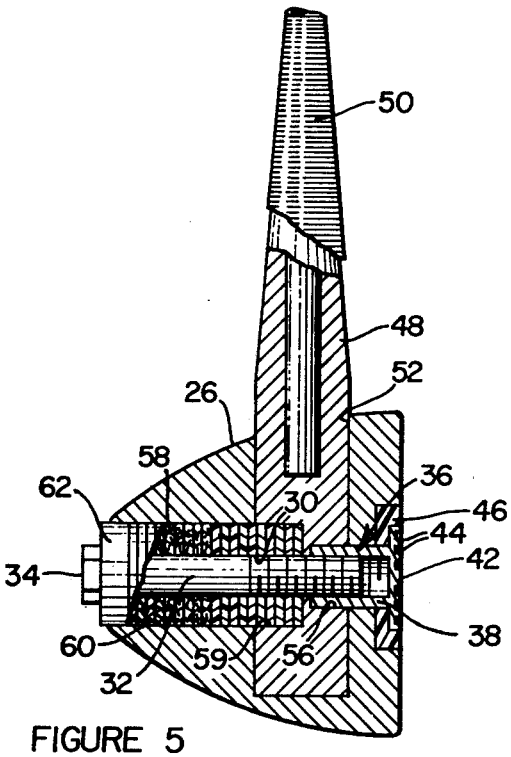
FIG. 5 is a sectional view taken along the line 5—5 of FIG. 4, looking in the direction of the arrows.
Figure 4:
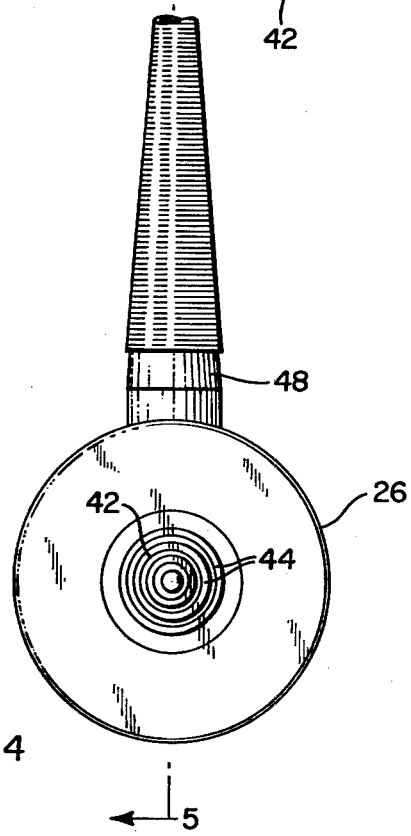
FIG. 4 is an enlarged fragmentary front elevational view of the club head and hosel of the present invention.
Figure 6:
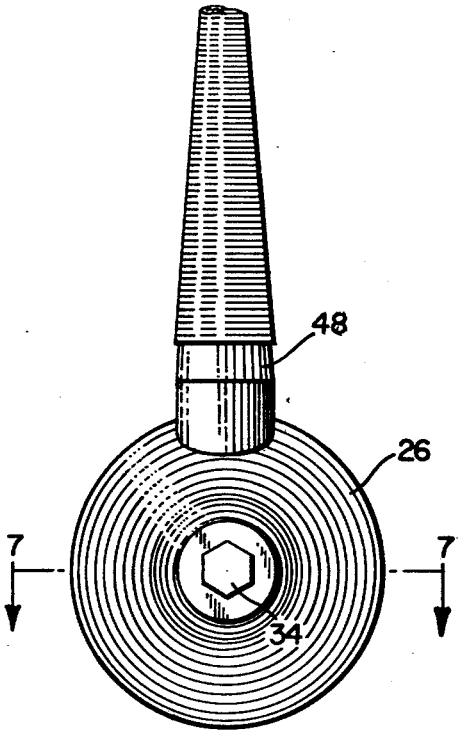
FIG. 6 is a rear elevational view of the club head and hosel of the present invention.
Figure 7:
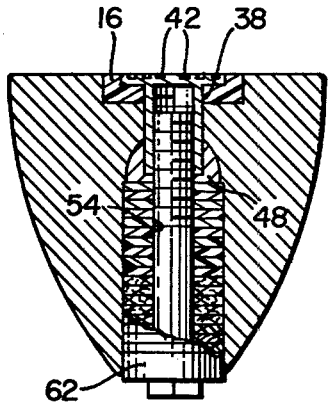
FIG. 7 is a sectional view taken along the line 7—7 of FIG. 6, looking in the direction of the arrows.

Club head assembly 24 includes a club head body 26 of phenolic resin, wood or other suitable material, which is of substantially semi-ellipsoidal shape and provided with a striking face 28. As shown in FIGS. 5 and 7, an axial bore 30 extends from the center of striking face 28 to the aft end thereof. A weight member in the form of a bolt having a threaded shaft 32 and a head 34 extends from the aft end of body 26 through bore 30 into threaded engagement with a tubular nut generally designated 36 lying along the longitudinal axis of club head body 26 proximate striking face 28. Tubular nut 36 includes an internally threaded sleeve 38 which is engaged by threaded shaft 32. Tubular nut 36 further includes a flat circular disk 42 engaged with the outer terminal of sleeve 38, which circular disk is uniplaner with striking face 28 of club head body 26 in this form of the invention. Circular disk 42 constitutes the "sweet spot" or target for hitting the golf ball and, in order to control the flight of the ball, the disk is provided with a series of concentric circular recesses 44. Tubular nut 36 is held in position by means of an epoxy element 46 or other suitable composition placed in a counter bore in striking face 28 and firmly holding the nut in place.

Club head 24 further includes a hosel 48 into which the lower end of shaft 20 is inserted in the manner shown in FIG. 5, the shaft being conventionally held in position by a pin and/or adhesive means. The outer surface of the hosel is wrapped in a conventional manner as shown at 50. The opposite end of hosel 48 is inserted through a bore 52 which is at a right angle to axial bore 30 of club head 26, bore 52 being spaced from both the fore and aft ends of the club head body but closer to striking face 28.

The portion of hosel 48 within club head body 26 is provided with a transverse bore 54 through which threaded shank 32 of the weight member passes. Transverse bore 54 is further counter-bored at 56 to receive a portion of internally threaded sleeve 38 of tubular nut assembly 36. This arrangement fixes hosel 48 in engagement with the club head body 26.

It is a feature of the present invention to countersink the aft end of axial bore 30 as indicated at 58, and the proximate portion of hosel bore 54, as indicated at 59, in order to permit the addition of a plurality of weights 60 in the form of washers or the like, of different materials, such as lead, iron, brass, fiber, wood, plastic, etc, thereby providing weight members of different weight value.

The weights are placed on shaft 32 and may be arranged to effect the addition of any desired weight and also if desired, to concentrate weight near the center of the club head or at the aft end thereof. It has been found that the concentration of weight near the center of the club head effects maximum control of the golf ball which concentration thereof at the aft end of the club head effects a change in the face angle of the club head as it strikes the ball, effecting greater loft.

An adapter 62 made of lightweight material such as plastic or wood may be employed, if needed, to fill the void between the weights and bolt head 34 to prevent longitudinal shifting of weights when the club is swung.

In accordance with the present invention, striking face 28 of club head body 26 may lie in a plane which is substantially perpendicular to the longitudinal axis of shaft 20 as shown in FIGS. 1 to 7, or may be at various angles thereto in order to produce a different degree of loft to the golf ball in a manner similar to that presently followed in the construction of conventional golf clubs. FIGS. 1 to 7 illustrate the application of the present invention to a putter.

Figure 9:
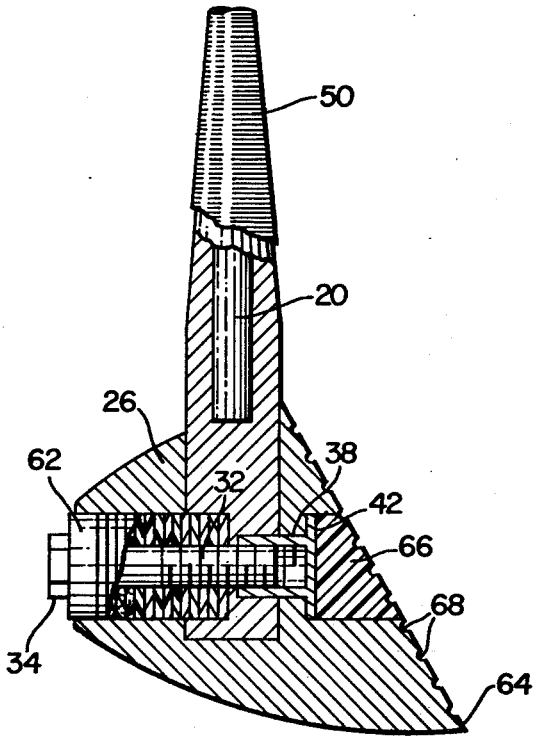
FIG. 9 is a sectional view taken along the line 9—9 of FIG. 8, looking in the direction of the arrows.
Figure 8:
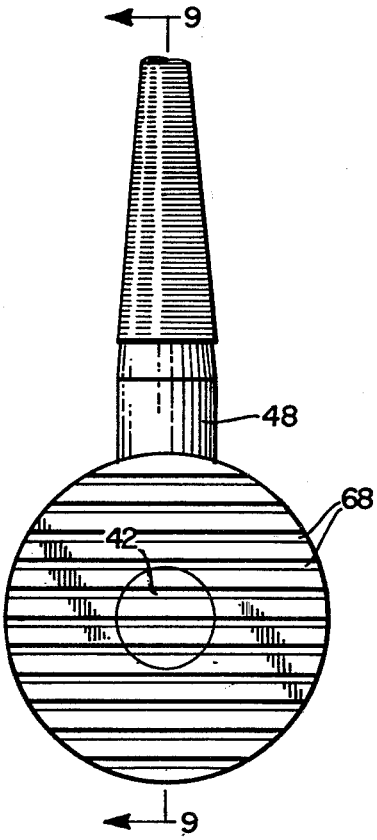
FIG. 8 is a front elevational view of a club head and hosel showing a modified form of the present invention.

DESCRIPTION OF FORM OF INVENTION ILLUSTRATED IN FIGS. 8 and 9

In FIGS. 8 and 9, there is illustrated a modified form of the present invention, wherein similar parts are identified by like, primed numbers. In this form of the invention, the striking face of club head body 26′ is indicated at 64 which striking face lies in a plane which is disposed at an angle of less than 90° to the longitudinal axis of shaft 20′. Additionally, circular disk 42′ does not lie flush with the surface of striking face 64 but is recessed with respect thereto, the space between the disk and the face being filled with a suitable resin material or the like indicated at 66. As shown in FIG. 8, the surface of striking face 64 is provided with a series of spaced parallel recesses 68 which lie in a plane at right angles to the longitudinal axis of shaft 20′ for controlling the flight of the ball.

DESCRIPTION OF FORM OF INVENTION ILLUSTRATED IN FIGS. 10 to 14

Figure 10:
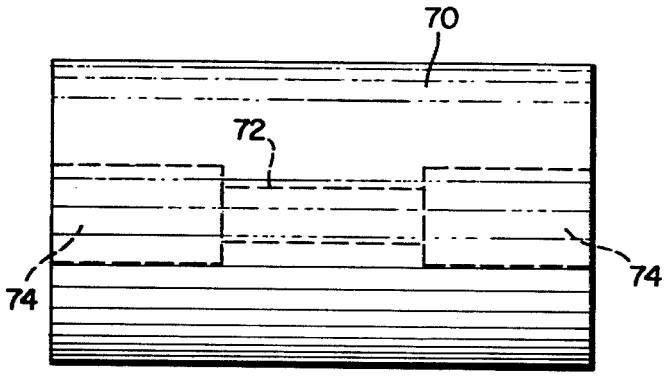
FIG. 10 is an elevational view of a block of material used in manufacturing the club heads of the present invention.
Figure 11:
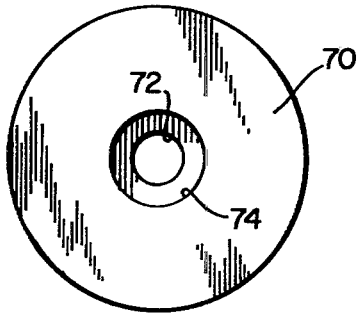
FIG. 11 is an end elevational view of the block of FIG. 10.

The process of manufacturing the club head of the present invention is illustrated to advantage in FIGS. 10 to 14. Referring to FIGS. 10 and 11, a block of material 70 made of phenolic resin, or other suitable hard material, is selected. The block of material is preferably approximately $4\frac{3}{4}$ inch in length and $2\frac{3}{4}$ inch in diameter. The block is first bored axially as indicated at 72 and the ends of the axial bore are then counterbored as indicated at 74 and 76.

Figure 12:
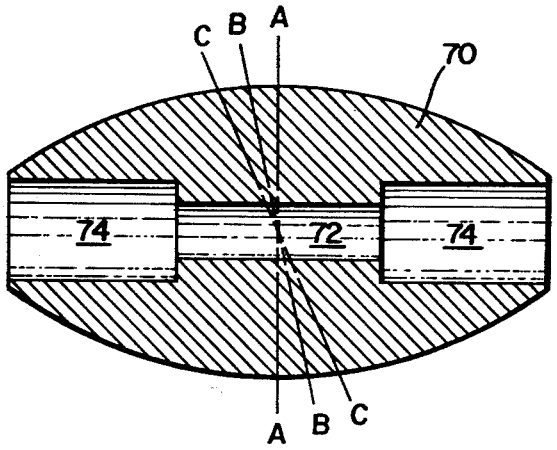
FIG. 12 is a sectional view of the block of FIG. 10 which has been machined to shape the same in accordance with the present invention.
Figure 13:
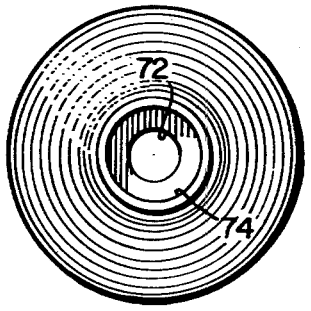
FIG. 13 is an end elevational view of the machined block shown in FIG. 12.
Figure 14:
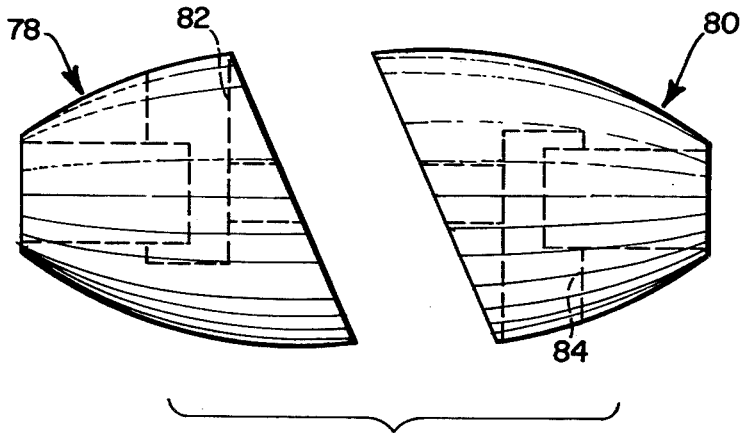
FIG. 14 is a side elevational view of a pair of club heads formed from the machined block of FIG. 12.

The outer periphery of the block of material is next turned to provide a block of ellipsoidal shape as shown in FIGS. 12 and 13.

The club head of the present invention is assembled by inserting hosel 48 into transverse bore 52 following which tubular nut 36 is placed in position in counterbore 56 and secured by composition 46. Threaded shaft 32 is then inserted into bore 30 from the aft end of the club head and is passed through transverse bore 54 of hosel 48 into threaded engagement with tubular nut 36.

The golf club of the present invention affords simple but effective means for centering the club head with respect to the club shaft and for maintaining a weighting member directly behind the ball-engaging area of the striking face. In this way, the maximum force is applied to the golf ball while at the same time accurately driving the ball toward the green.

While there has been herein shown and described the presently preferred forms of this invention, it is to be understood that such has been done for purposes of illustration, and that various changes may be made therein within the scope of the appended claims.

What is claimed is:

1. A golf club, including:
(a) a shaft
(b) a club head assembly, including a club head body having a striking face
(c) said club head body being provided with a longitudinal bore extending from the striking face to the aft end thereof
(d) a weight member positioned in the longitudinal bore behind the ball-engaging portion of the club head's striking face, and
(e) a hosel, one end of which is fixed to an end of said shaft
(f) the opposite end of said hosel extending through said club head body
(g) said opposite end of said hosel having a transverse bore through which said weight member passes.

2. The golf club head of claim 1, wherein
(a) said hosel extends through said club head body intermediate the striking face and the opposite end of the body.

3. The golf club of claim 1, wherein
(a) said club head is of semi-ellipsoidal shape.

4. The golf club of claim 1, wherein
(a) said weight member includes a bolt having a threaded shank (b) a tubular nut fixedly positioned in said club head body proximate the striking face thereof for threaded engagement with the threaded shank of said bolt.

5. The golf club of claim 4, wherein:

(a) said weight member further includes a plurality of weights selectively positioned on said bolt in spaced relation to the striking face of the club head body.

6. A golf club, including (a) a shaft (b) a club head assembly including a club head body of substantially semi-ellipsoidal shape and having a striking face (c) said club head body being provided with a longitudinal bore extending axially from the striking face to the aft end thereof.

(d) a weight member extending through the longitudinal bore of said club head body (e) said weight member including a bolt having a threaded shank (f) a tubular nut fixedly positioned in said club head body proximate the striking face thereof for threaded engagement with the threaded shank of said bolt (g) a plurality of weights selectively positioned on said threaded shank for varying the weight of said club head body (h) said semi-ellipsoidal club head body being provided with a radial bore spaced from the fore and aft ends thereof, said bore extending at substantially a right angle to, and in communication with, the longitudinal bore in said club head body, and (i) a hosel mounted in the radial bore in said club head body, one end of said hosel being fixed to an end of said shaft (j) the opposite end of said hosel being provided with a transverse bore through which the threaded shank of said bolt passes for fixedly engaging said hosel, and the shaft connected thereto, to said club head body.

7. The golf club of claim 6 wherein (a) a portion of the longitudinal bore of the club head body and the transverse bore of said hosel are counterbored for locating a portion of said weights proximate the center of said club head body.

8. The golf club of claim 6 wherein (a) said weights are of different weight value for placement at any desired point in the longitudinal bore of the club head body between the central part and the aft end thereof.

9. The golf club of claim 6, wherein (a) said tubular nut includes an internally threaded sleeve engaged by said threaded shank (b) a flat, circular disk engaged with the outer terminal of said threaded sleeve (c) said disk being uniplanar with the striking face of said club head body 10. The golf club of claim 6, wherein (a) the longitudinal bore of said club head body is counterbored proximate the striking face of said club head body, and (b) adhesive means in the counterbore proximate the striking face of the club head body, and engageable with said flat, circular disk, for holding said tubular nut in fixed relation to said club head body.

11. A golf club including:

(a) a shaft (b) a club head assembly comprising a club head body having a striking face at the forward end thereof.

(c) said club head body being provided with a longitudinal bore extending completely through the club head body from the striking face to the aft end thereof (d) a bolt having a threaded shank positioned in the longitudinal bore (e) a ball-engaging member connected to the forward end of said threaded shank and coplanar with the striking face of said club head body (f) a plurality of weights selectively positioned on said bolt in spaced relation to the striking face of the club head body, and (g) means extending through said club head body for connecting one end of said shaft to said bolt intermediate the striking face and the aft end of the club head body, whereby the weight of the club head assembly is centered with respect to said shaft.

12. The golf club of claim 11, wherein:

(a) said club head body is of substantially semi-ellipsoidal shape.

13. The golf club of claim 12 wherein:

(a) said means includes a hosel extending radially through said semi-ellipsoidal club head body.

14. The golf club of claim 11 wherein:

(a) said ball-engaging member includes an internally threaded sleeve threadedly engaged with one end of said threaded shank (b) a flat circular disk engaged with the outer terminal of said threaded shank (c) said disk being uniplanar with the striking face of said club head body.

15. The golf club of claim 14, wherein:

(a) the longitudinal bore of said club head body is counterbored from the aft end to a point intermediate the length thereof for locating said weights therein (b) said longitudinal bore being counterbored proximate the striking face of said club head body, and (c) adhesive means in the counterbore proximate the striking face of the club head body, and engageable with said flat circular disk, for holding said internally threaded sleeve and flat circular disk in fixed relation to said club head body.

* * * * *